US012527988B1

(12) United States Patent
Zhang

(10) Patent No.: US 12,527,988 B1
(45) Date of Patent: Jan. 20, 2026

(54) PUSH-UP BOARD

(71) Applicant: Xiancong Zhang, Hunan (CN)

(72) Inventor: Xiancong Zhang, Hunan (CN)

( * ) Notice: Subject to any disclaimer, the term of this patent is extended or adjusted under 35 U.S.C. 154(b) by 0 days.

(21) Appl. No.: 19/307,484

(22) Filed: Aug. 22, 2025

(51) Int. Cl.
*A63B 23/12* (2006.01)

(52) U.S. Cl.
CPC ..... *A63B 23/1236* (2013.01); *A63B 2220/17* (2013.01)

(58) Field of Classification Search
CPC ..... A63B 23/1236; A63B 2220/17
See application file for complete search history.

(56) References Cited

U.S. PATENT DOCUMENTS 5,226,868 A * 7/1993 Montgomery ..... A63B 21/4035 482/141
10,463,911 B2 * 11/2019 Chapman ..... A63B 21/0059
11,491,368 B2 * 11/2022 Hao ..... A63B 23/1236
D1,030,924 S * 6/2024 Xiao ..... D21/682
2005/0148448 A1 * 7/2005 Mersch ..... A63B 21/4035 482/141
2012/0316043 A1 * 12/2012 Mangalindan ..... A63B 23/1236 482/141
2014/0141949 A1 * 5/2014 Mills ..... A63B 21/4045 482/140
2014/0171278 A1 * 6/2014 Orenstein ..... A63B 21/00047 482/141
2020/0298056 A1 * 9/2020 Cheng ..... A63B 21/4035
2022/0054890 A1 * 2/2022 Owusu ..... A63B 71/0622
2023/0166154 A1 * 6/2023 Hsu ..... A63B 21/4035 482/141

* cited by examiner

*Primary Examiner* — Joshua Lee
(74) *Attorney, Agent, or Firm* — JEEN IP LAW, LLC

(57) ABSTRACT

A push-up board includes a board body and a plurality of data collectors arranged on the board body. The board body has at least two usage modes for user selection, when one of the at least two usage modes is selected, the data collectors are configured to collect data on push-ups under the one of the at least two usage modes.

18 Claims, 17 Drawing Sheets

PUSH-UP BOARD

FIELD

The present disclosure relates to fitness exercise equipment, particularly to a push-up board with multiple usage modes.

BACKGROUND

With progress of society, pace of modern life in terms of work, daily activities, and other aspects has become increasingly rapid, leading to significant mental stress among contemporary individuals. Currently, a diverse range of fitness exercise equipment are available on the market to help people vent emotions and alleviate stress. Among these, a push-up board is one of the fitness exercise equipment that not only aids in stress relief but also serves as a tool for physical exercise. In existing technologies, the push-up board is only used for exercise and cannot provide feedback on the push-up exercise situation to the user. Its function is relatively single and it is difficult to meet the user's exercise needs.

SUMMARY

In order to solve shortcomings in existing technologies, the present disclosure is to provide a push-up board with multiple usage modes.

A push-up board provided by the present disclosure includes a board body and a plurality of data collectors arranged on the board body. The board body has at least two usage modes for user selection, when one of the at least two usage modes is selected, the data collectors are configured to collect data on push-ups under the one of the at least two usage modes.

In one or more embodiments of the present disclosure, the board body comprises a housing and handles, wherein the housing has an exercise area, a plurality of positioning sections each corresponding to one of the at least two usage modes are arranged in the exercise area; when the handles are fitted with one of the positioning sections, one of the at least two usage modes corresponding to the one of the positioning sections is selected.

In one or more embodiments of the present disclosure, when the handles are fitted with one of the positioning sections, the handles are configured to trigger one of the data collectors to start recording data on the push-ups.

In one or more embodiments of the present disclosure, each handle includes at least one insertion part, the positioning sections include positioning holes, the data collectors correspond to the positioning holes, each insertion part is configured to trigger corresponding one of the data collectors when such insertion part is inserted into one of the positioning holes corresponding to the one of the data collectors.

In one or more embodiments of the present disclosure, a bottom of each insertion part is provided with an elastic triggering component, each data collector is arranged at a bottom of a corresponding one of the positioning holes, and the elastic triggering component is configured to elastically trigger a corresponding one of the data collectors at the bottom of the corresponding one of the positioning holes.

In one or more embodiments of the present disclosure, each positioning hole corresponds to one of the data collectors.

In one or more embodiments of the present disclosure, the data collectors comprise a pressure sensor and a timer.

In one or more embodiments of the present disclosure, the pressure sensor is configured to collect data on a number of the push-ups and a pressure exerted on the push-up board, and the timer is configured to collect data on duration of the push-ups.

In one or more embodiments of the present disclosure, the pressure sensor is a thin-film pressure sensor.

In one or more embodiments of the present disclosure, the timer is an infrared timer or a magnetic timer configured to detect the insertion part to initiate timing.

In one or more embodiments of the present disclosure, the magnetic timer comprises a Hall effect sensor arranged in a corresponding one of the positioning holes and a magnet arranged at a corresponding one of the insertion parts.

In one or more embodiments of the present disclosure, the timer is a push-button timer and is configured to start timing when a corresponding one of the insertion parts of the handles applies pressure to the push-button timer.

In one or more embodiments of the present disclosure, a circuit board is arranged at a bottom of the positioning holes, the push-button timer comprises a first conducting pin, a second conducting pin, and an elastic button; both the first conducting pin and the second conducting pin are arranged on the circuit board and remain in a normally open state; a bottom of the elastic button is provided with a conductive part; when a corresponding one of the insertion parts of the handles applies pressure to the elastic button, the elastic button undergoes elastic deformation, causing the conductive part at the bottom of the elastic button to electrically connect the first conducting pin and the second conducting pin.

In one or more embodiments of the present disclosure, the data collector is an infrared counter configured to be arranged on the housing to sense and count the push-ups when the user performs the push-ups.

In one or more embodiments of the present disclosure, the housing comprises a central housing, and the infrared counter is arranged in the central housing.

In one or more embodiments of the present disclosure, the usage modes comprise at least two of a chest mode, a back mode, a shoulder mode, and an arm mode.

In one or more embodiments of the present disclosure, the exercise area is provided with a plurality of color markings, each usage mode corresponds to one of the color markings, and each color marking corresponds to one of the positioning sections.

In one or more embodiments of the present disclosure, the positioning sections comprise a chest positioning section, a back positioning section, a shoulder positioning section, and an arm positioning section, the chest positioning section is marked with a first color marking, the back positioning section is marked with a second color marking, the shoulder positioning section is marked with a third color marking, and the arm positioning section is marked with a fourth color marking, so that one of the positioning sections is capable of being selected based on the color markings.

Embodiments of the present disclosure further provides a ush-up board, which includes a board body and a plurality of data collectors arranged on the board body. The board body has at least two of a chest mode, a back mode, a shoulder mode, and an arm mode for user selection, when one of the usage modes is selected, the data collectors are configured to collect data under the one of the at least two usage modes.

Embodiments of the present disclosure further provides a ush-up board, which includes a board body and a plurality of data collectors arranged on the board body. The board body has at least two of a chest mode, a back mode, a shoulder mode, and an arm mode for user selection, when one of the usage modes is selected, the data collectors are configured to collect data on push-ups under the one of the at least two usage modes; the data on the push-ups comprises at least one of a number of the push-ups, duration of the push-ups, pressure data on the push-ups.

The beneficial effects of the present disclosure are: in the push-up board provided by the present disclosure, during use, since the push-up board is equipped with the data collector and offers at least two usage modes for users to choose from, when a user selects one of these usage modes, the data collector can gather push-up data corresponding to the selected mode. This assists users in recording push-up data across different usage modes, facilitating effective exercise for them.

BRIEF DESCRIPTION OF THE DRAWINGS

In order to more clearly illustrate technical solutions in the embodiments of the present disclosure, the accompanying drawings required in the description of the embodiments will be briefly introduced below. The accompanying drawings in the description below are only some embodiments of the present disclosure. For those of ordinary skilled in the art, other accompanying drawings can also be obtained based on these accompanying drawings without expending creative labor.

The present disclosure is further described below in conjunction with the accompanying drawings and embodiments.

DETAILED DESCRIPTION

Figure 1:
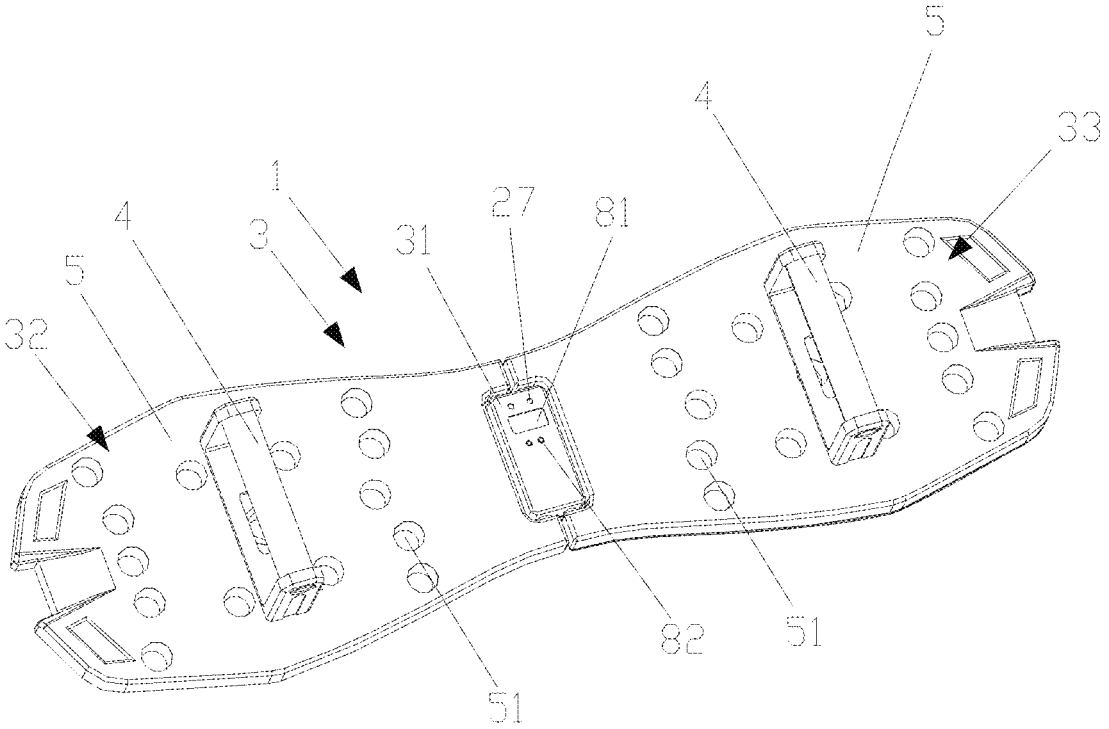
FIG. 1 is a schematic structural diagram of a push-up board according to an embodiment of the present disclosure.

Please referring to FIGS. 1-17, a push-up board with multiple usage modes provided by an embodiment of the present disclosure includes a board body 1 and a plurality of data collectors 2 arranged on the board body 1. The board body 1 offers at least two usage modes for users to choose from. When a user selects one of the at least two usage modes, the data collectors 2 are configured to collect push-up data under the selected usage mode.

In the push-up board of the present disclosure, during use, since the push-up board is equipped with the data collectors and offers at least two usage modes for user selection, when a user selects one of the at least two usage modes, the data collectors can capture push-up data corresponding to the one of the at least two usage modes. This aids users in recording push-up data across different modes, facilitating effective exercise. The push-up data includes at least one of the following: push-up count data, push-up duration data, and push-up pressure data.

In some embodiments, the board body 1 includes a housing 3 and handles 4. The housing 3 includes an exercise area 5 where positioning sections 51 corresponding to different usage modes are arranged. When the handles 4 are fitted into one of the positioning sections 51, it indicates that the usage mode associated with the one of the positioning sections has been selected. The selection of usage modes through the handles and their corresponding positioning sections offers a simple structure and convenient use.

Furthermore, when the handle 4 are fitted into one of the positioning sections 51, it triggers one of the data collectors 2 corresponding to the one of the positioning sections, enabling data collection. This design not only uses the handle as a medium for mode selection but also triggers the data collector through the handle's interaction with the positioning section, offering convenience in use.

Specifically, each handle 4 includes an insertion part 41, and each positioning section 51 is a positioning hole. The data collector 2 is positioned corresponding to the positioning hole. When the insertion part 41 of the handle 4 is inserted into the positioning hole, it triggers the data collector 2 corresponding to that positioning hole. Additionally, each positioning hole corresponds to a corresponding one of the data collectors 2.

Figure 2:
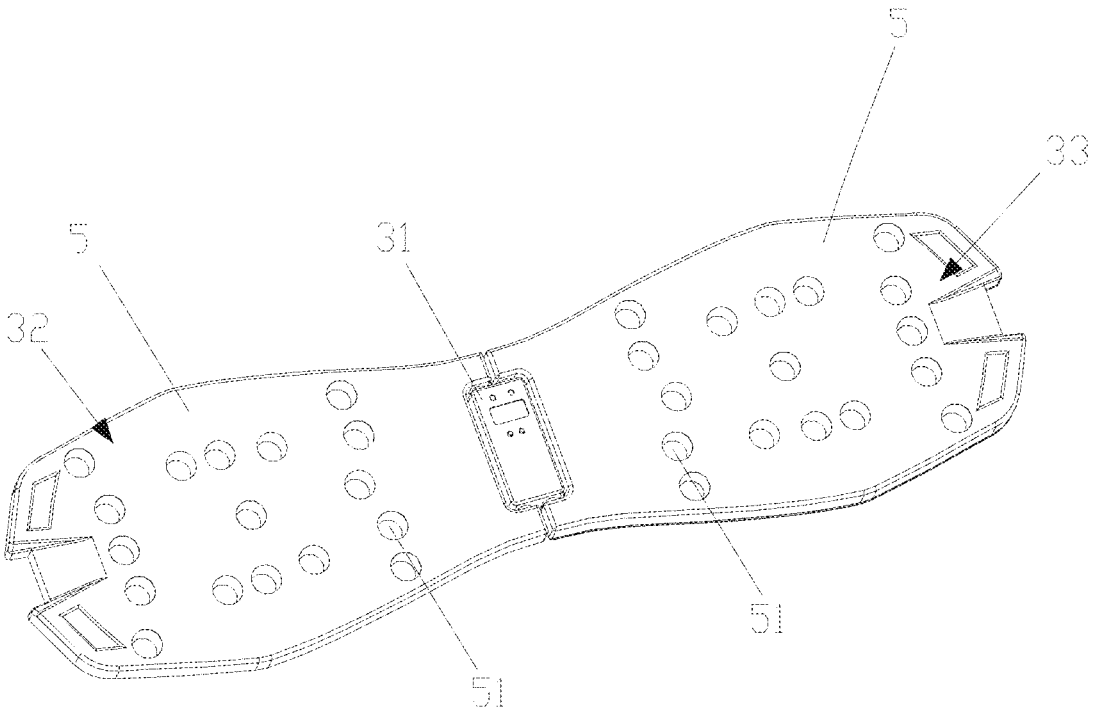
FIG. 2 is a schematic structural diagram of the push-up board in FIG. 1 with handles being removed.
Figure 3:
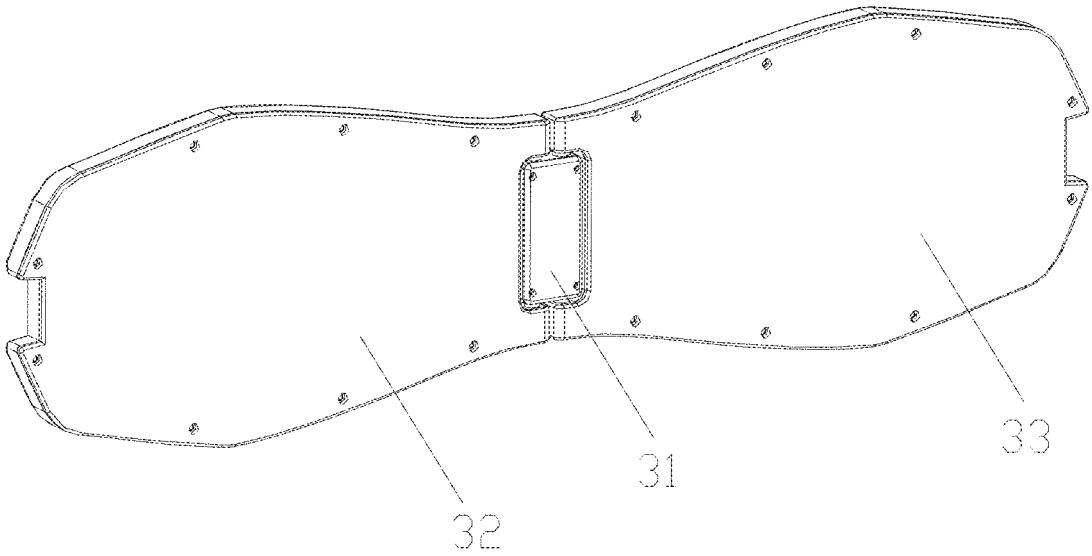
FIG. 3 is a schematic view of the push-up board from another angle.
Figure 4:
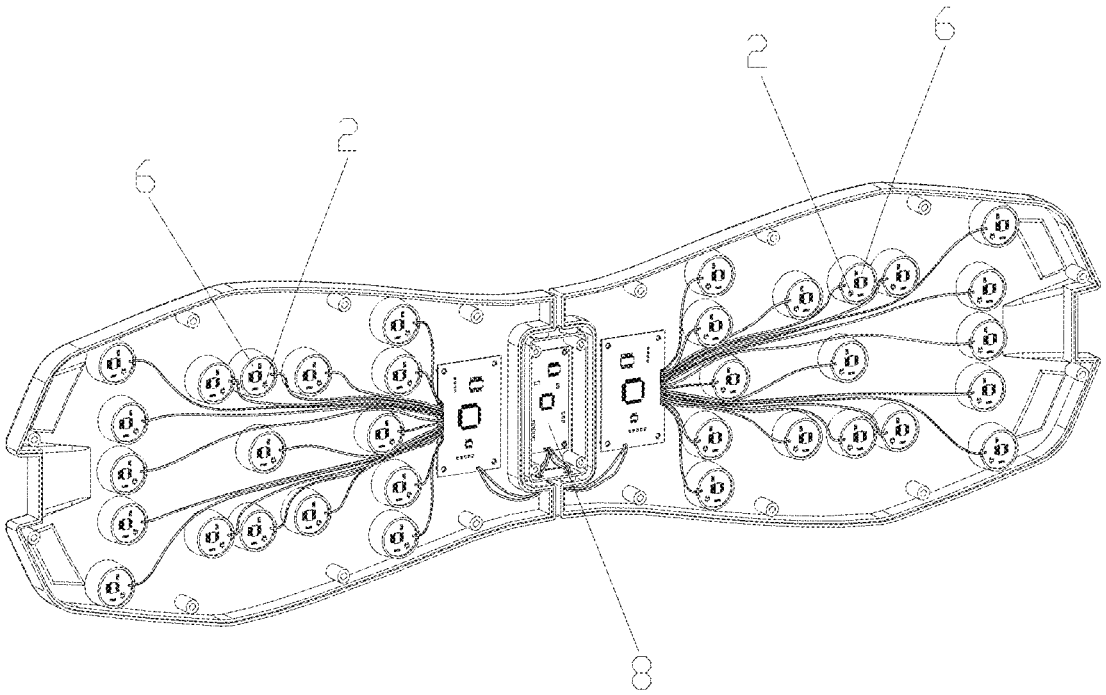
FIG. 4 is a schematic diagram of an internal structure of the push-up board, illustrating a first layout arrangement of the circuit boards.
Figure 5:
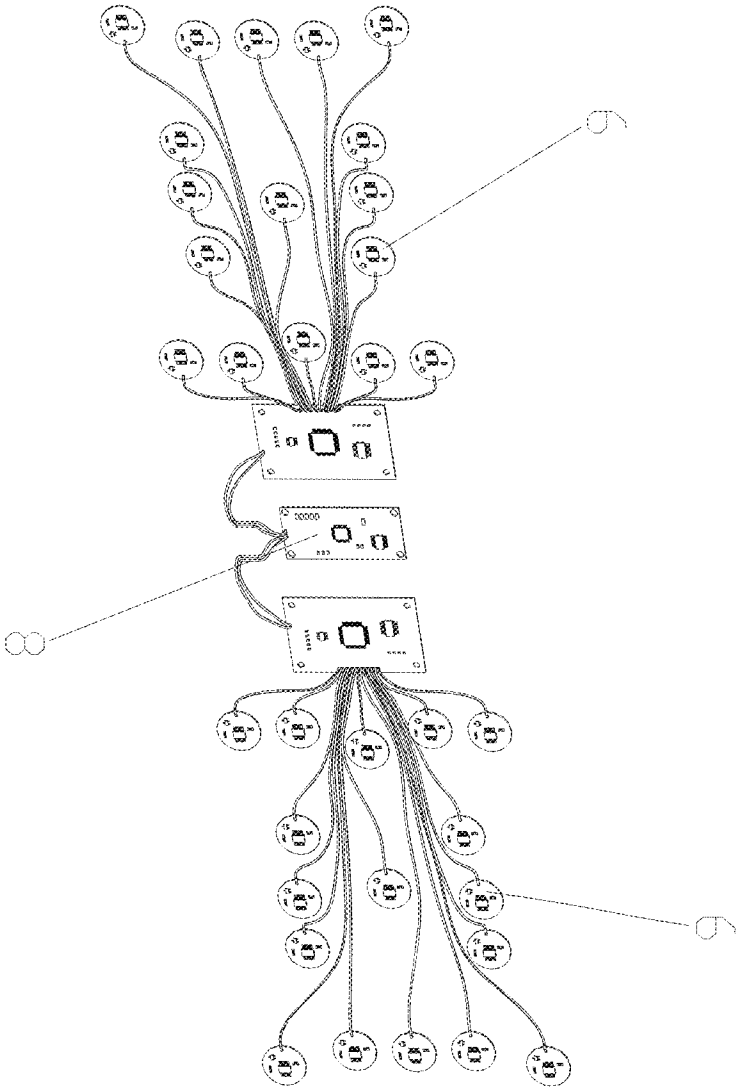
FIG. 5 is a schematic diagram depicting the first layout arrangement of the circuit boards.
Figure 6:
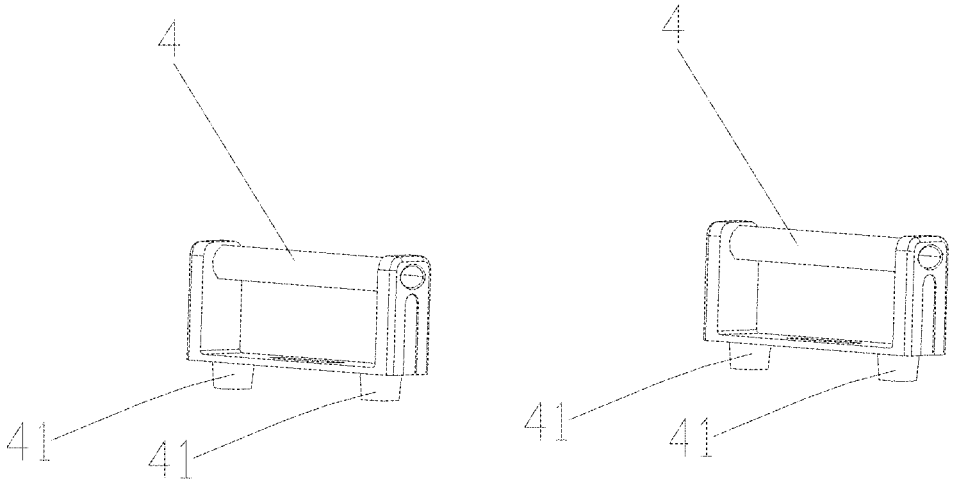
FIG. 6 is a schematic diagram showing structures of the handles
Figure 7:
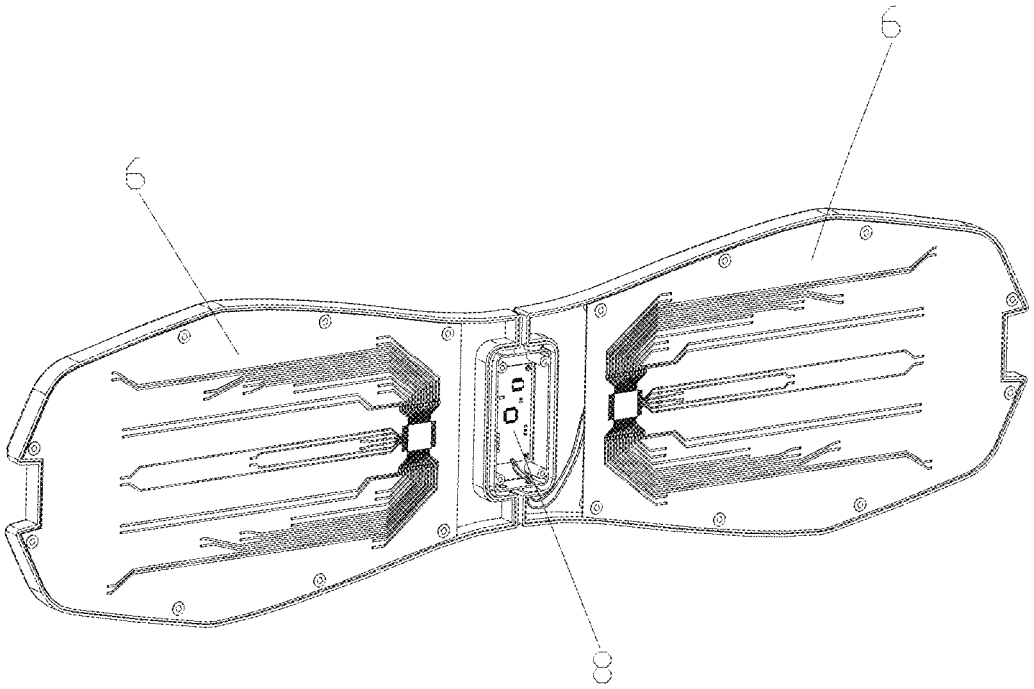
FIG. 7 is a schematic diagram of an internal structure of the push-up board, illustrating a second layout arrangement of the circuit boards.
Figure 8:
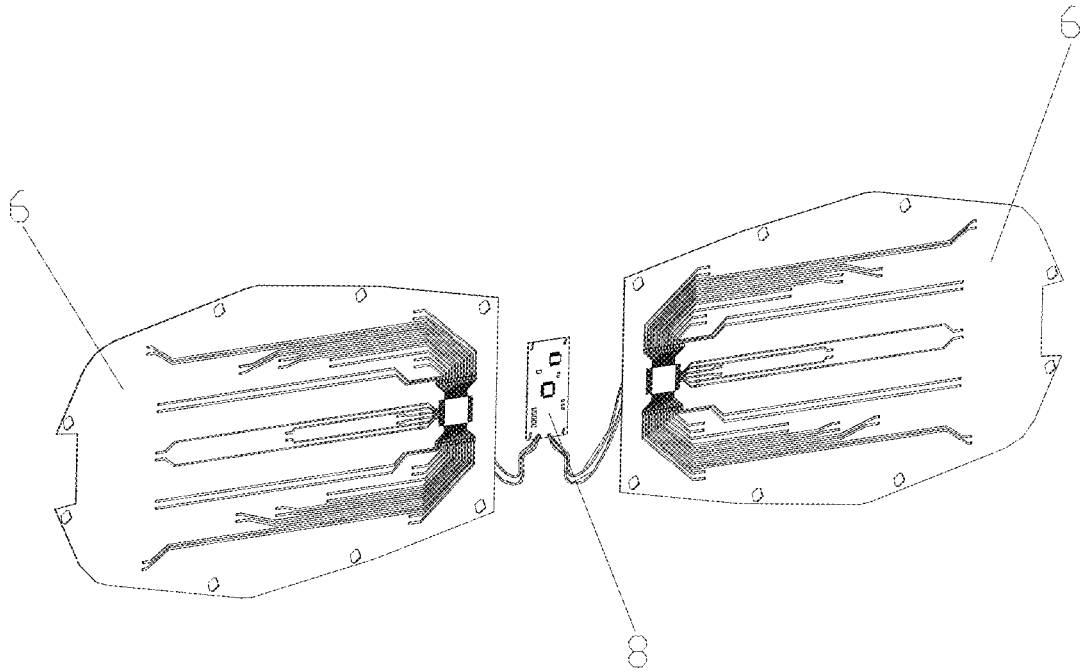
FIG. 8 is a schematic diagram depicting the second layout arrangement of the circuit boards.
Figure 9:
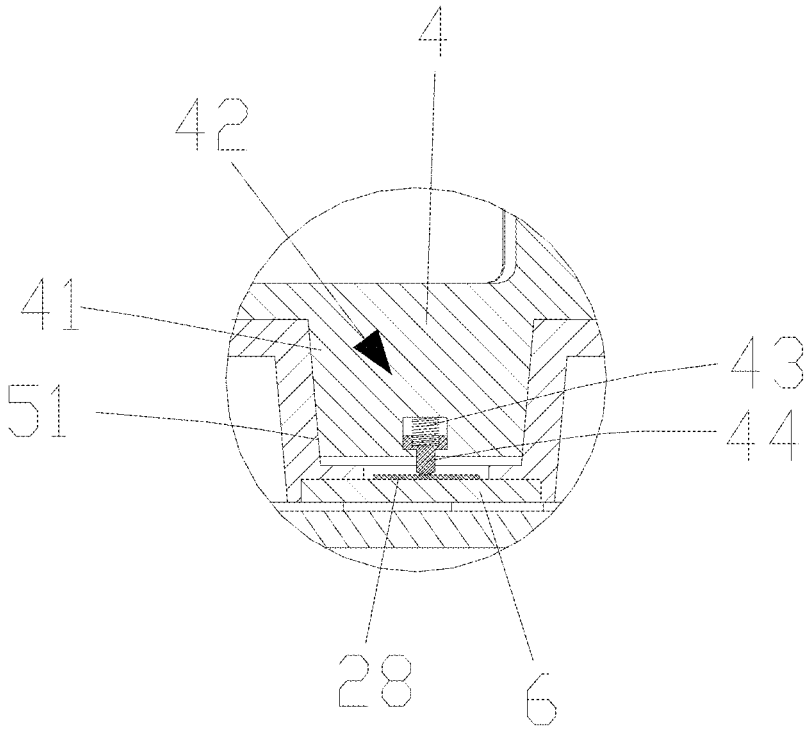
FIG. 9 is a schematic diagram illustrating a thin-film pressure sensor being triggered.
Figure 10:
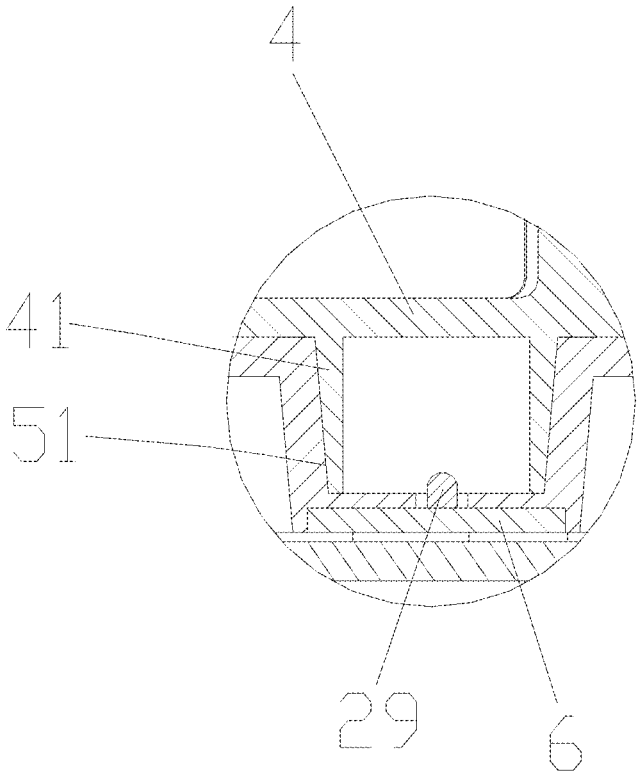
FIG. 10 is a schematic diagram illustrating an infrared timer being triggered.
Figure 11:
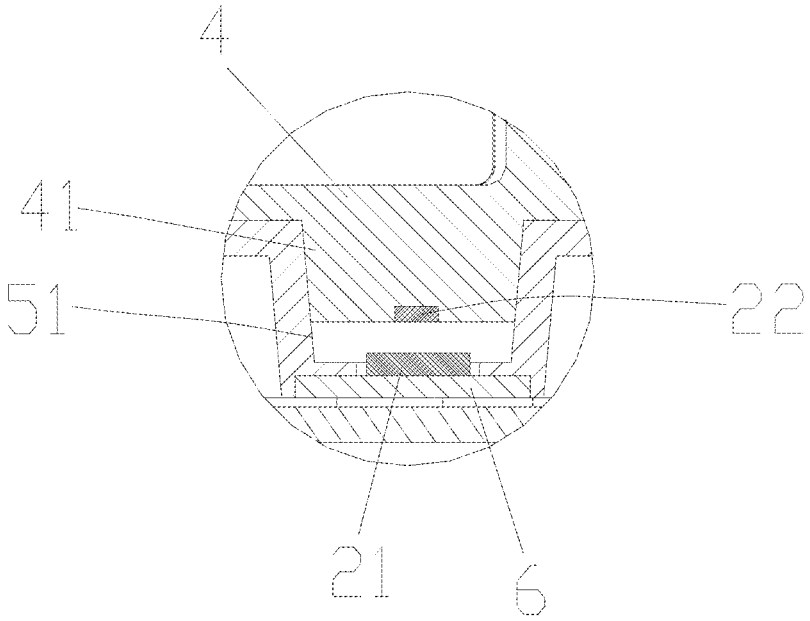
FIG. 11 is a schematic diagram illustrating a magnetic timer being triggered.
Figure 12:
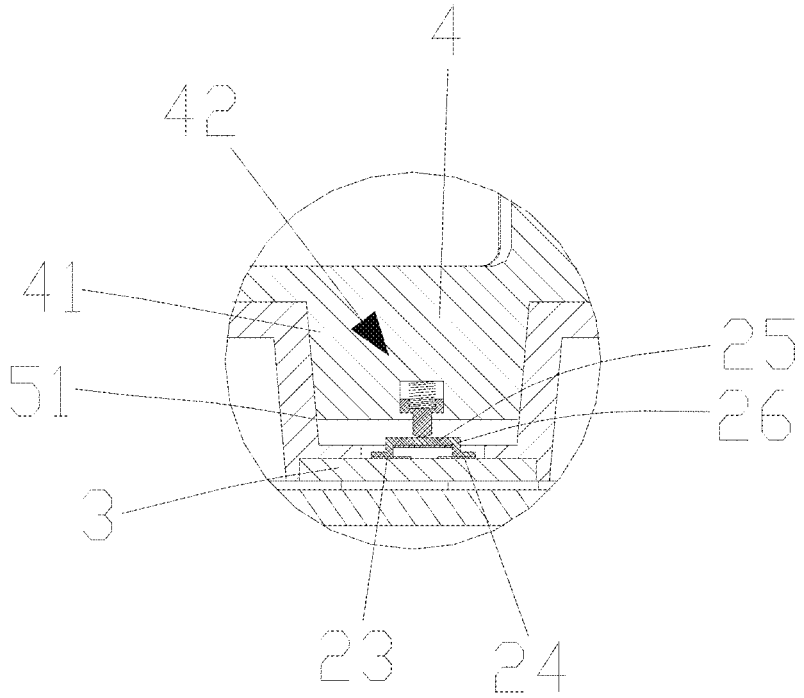
FIG. 12 is a schematic diagram illustrating a push-button timer being triggered.
Figure 13:
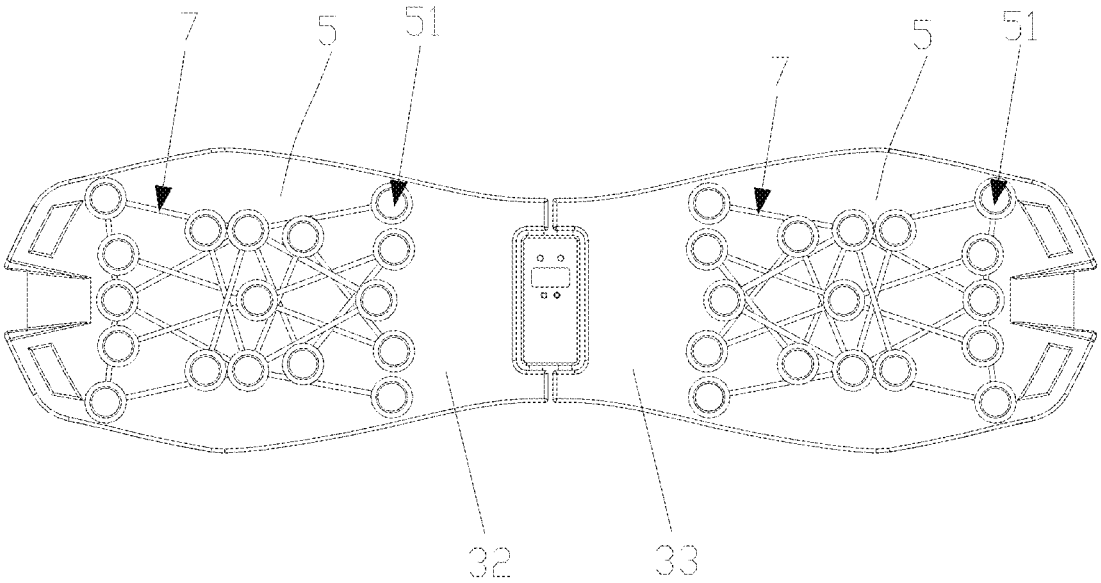
FIG. 13 is a schematic diagram of the push-up board with multi-colored markings.
Figure 14:
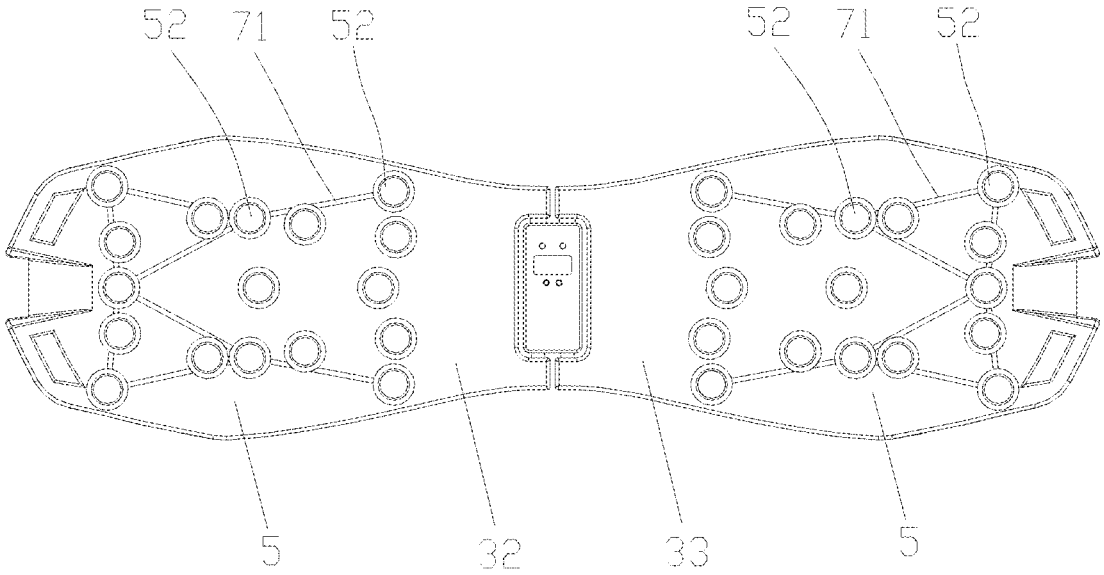
FIG. 14 is a schematic diagram of the push-up board with color markings; specifically, the color marking is blue.
Figure 15:
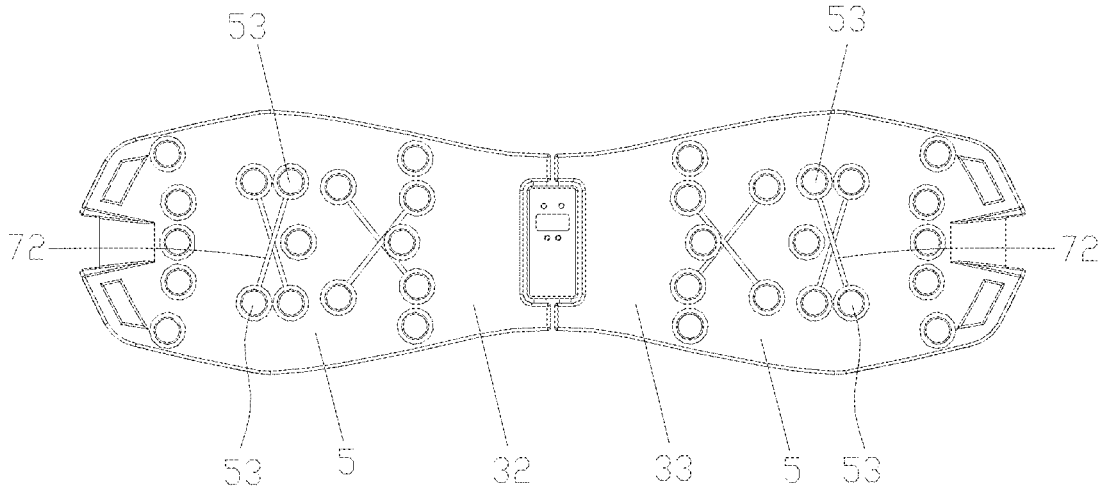
FIG. 15 is a schematic diagram of the push-up board with color markings; specifically, the color marking is yellow.
Figure 16:
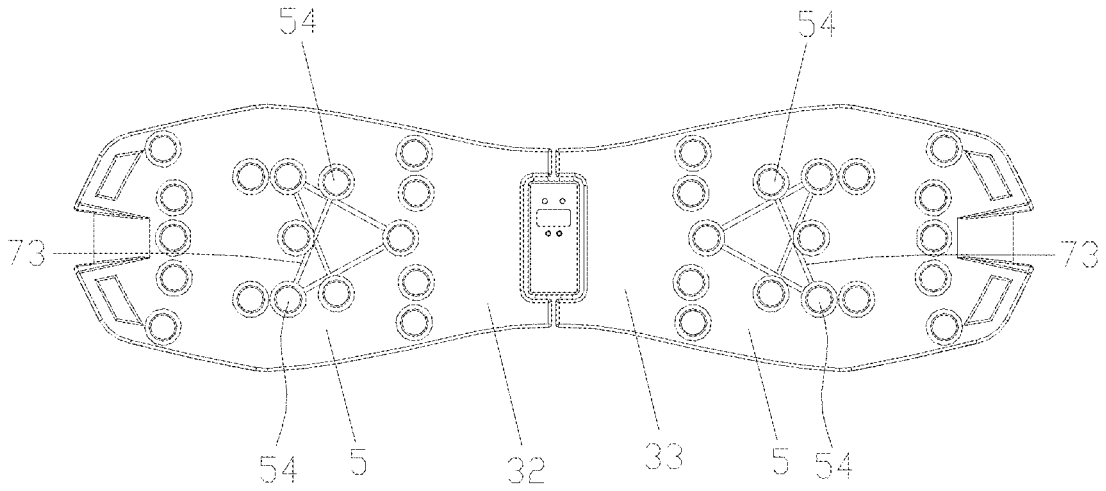
FIG. 16 is a schematic diagram of the push-up board with color markings; specifically, the color marking is red.
Figure 17:
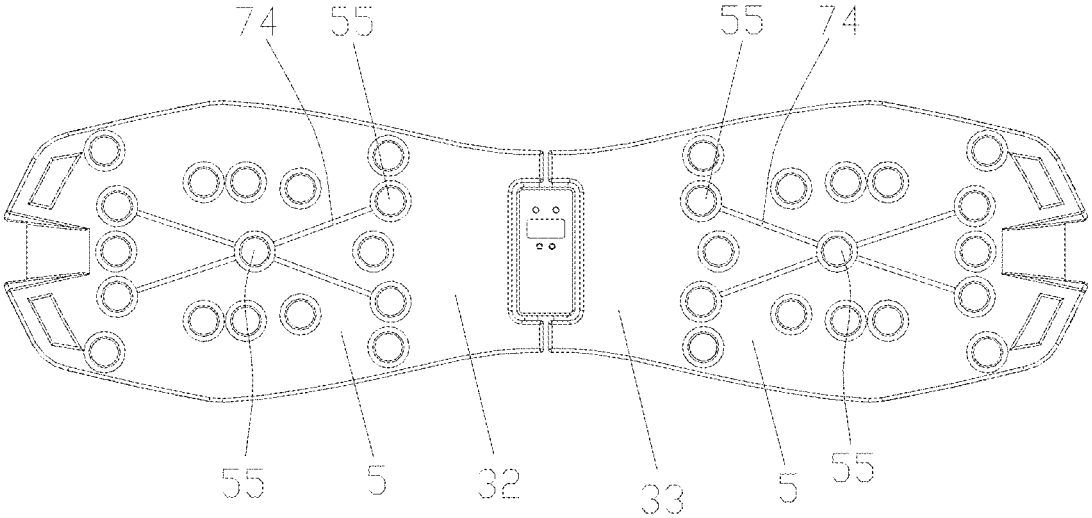
FIG. 17 is a schematic diagram of the push-up board with color markings; specifically, the color marking is green.

In some embodiments, referring to FIGS. 1-3, the housing 3 includes a central housing 31, a left housing 32, and a right housing 33. Accordingly, the exercise area is divided into a left exercise area and a right exercise area, which are located on the left housing 32 and right housing 33 respectively. Both the left exercise area and the right exercise area contain multiple positioning sections. Each positioning section may consist of two positioning holes. Specifically, there are 17 positioning holes in the left exercise area and 17 positioning holes in the right exercise area. Moreover, the handles can include a left handle and a right handle. Each of the left handle and the right handle has two insertion parts configured to be fitted into the positioning sections of the left and right exercise areas, respectively.

Furthermore, circuit boards 6 are installed inside both the left and right housings, positioned at the bottom of the positioning holes. The data collectors can be placed on the circuit boards. There can be multiple circuit boards. The number of the circuit boards is equal to the number of the positioning holes, and the number of the data collectors is equal to the number of the positioning holes. Alternatively, the circuit board in the left housing can be a single integrated board covering the bottom of all positioning holes in the left exercise area; similarly, the circuit board in the right housing can be a single integrated board covering the bottom of all positioning holes in the right exercise area.

Furthermore, a control circuit board 8 is installed inside the central housing. The circuit boards in the left housing and the circuit boards in the right housing are electrically connected to the control circuit board. Additionally, the control circuit board can be equipped with indicators (such as a display screen 81, indicator lights, etc.) to notify users when the handles are properly fitted, allowing them to perform exercise operations. Operation buttons 82 are arranged on the central housing for convenient use.

Moreover, the bottom of each insertion part 41 is equipped with an elastic triggering component 42, and the data collector 2 is positioned at the bottom of the positioning hole. Therefore, the insertion part can elastically trigger the data collector 2 corresponding to that positioning hole. The elastic triggering component 42 may include a spring 43 and a trigger head 44. Such elastic triggering mechanism is particularly beneficial for protecting data collectors such as thin-film pressure sensors and push-button timers.

In some embodiments, the usage modes include at least two of the following: a chest mode, a back mode, a shoulder mode, and an arm mode. Specifically, the usage modes may include all four modes mentioned above, or any combination of two or three of the four modes. Preferably, the usage modes include all four modes: the chest mode, the back mode, the shoulder mode, and the arm mode. The chest mode primarily targets user's chest muscles, the back mode focuses on back muscles, the shoulder mode works on shoulder muscles, and the arm mode targets arm muscles.

Furthermore, the exercise area 5 is marked with multiple color markings 7. Each usage mode corresponds to a corresponding color marking 7, and each color marking 7 corresponds to one or more of the positioning sections 51.

Additionally, the positioning sections 51 include a chest positioning section 52, a back positioning section 53, a shoulder positioning section 54, and an arm positioning section 55. The chest positioning section 52 is marked with a first color marking 71, the back positioning section 53 with a second color marking 72, the shoulder positioning section 54 with a third color marking 73, and the arm positioning section 55 with a fourth color marking 74, enabling users to select different positioning sections 51 based on the color markings. The first color marking can be blue, the second color marking yellow, the third color marking red, and the fourth color marking green. Each color marking can be formed as a colored strip between two positioning holes. Different color markings corresponding to different usage modes.

In some embodiments, the data collectors 2 can include a pressure sensor, a timer, and an infrared counter 27, etc. Of course, other types of data collectors can be used as long as they can fulfill the function of data collection. The pressure sensor can collect data on the number of push-ups and the pressure exerted on the push-up board; the timer can collect data on the duration of push-ups, and the infrared counter can collect data on the number of push-ups.

Specifically, the pressure sensor is a thin-film pressure sensor 28. During use, when the insertion parts of the handles are inserted into the positioning holes, the elastic triggering components on the insertion parts applies pressure to the thin-film pressure sensors to trigger the thin-film pressure sensors, indicating that the handles are properly inserted and allowing the user to perform exercise operations in the selected usage mode. During exercise, the thin-film pressure sensors can obtain data on the number of push-ups performed by the user in the selected mode and the pressure exerted on the push-up board during push-ups. This data can be used to record the user's exercise volume and assess whether the push-up posture is standard based on changes in pressure data, providing a reference for adjusting the push-up posture.

Specifically, the timer is an infrared timer 29, which senses the insertion parts 41 of the handles 4 to start timing. During use, when the insertion parts of the handles are inserted into the positioning holes, the infrared timer 29 senses the insertion of the insertion parts and sends a feedback signal to the control circuit board, indicating that the insertion parts (handles) are properly inserted and the usage mode corresponding to that positioning holes has been selected. At this point, the infrared timer begins recording the duration of push-ups performed by the user in that usage mode.

Specifically, the timer is a magnetic timer configured to sense the insertion parts 41 of the handles 4 to initiate timing. Moreover, the magnetic timer includes a Hall effect sensor 21 and a magnet 22. The Hall effect sensor 21 is positioned adjacent to the positioning holes, while the magnet 22 is mounted on the insertion part 41 of the handle 4. During use, when each insertion part is inserted into the positioning hole, the Hall effect sensor on the circuit board detects the magnet on the insertion part, indicating that the insertion part (handle) has been properly inserted and the usage mode corresponding to that positioning hole has been selected. At this point, the magnetic induction timer begins recording the duration of push-ups performed by the user in that usage mode.

Specifically, the timer is a push-button timer and is configured to start timing when the insertion part 41 of the handle 4 applies pressure to it. The bottom of the positioning hole is equipped with the circuit board 6, and the push-button timer includes a first conducting pin 23, a second conducting pin 24, and an elastic button 25. Both the first conducting pin 23 and the second conducting pin 24 are installed on the circuit board 6 and remain in a normally open state. The bottom of the elastic button 25 is provided with a conductive part 26. When the insertion part 41 of the handle 4 applies pressure to the elastic button 25, the elastic button undergoes elastic deformation, causing the conductive part 26 at the bottom of the elastic button to electrically connect the first conducting pin 23 and the second conducting pin 24. The elastic button can be a silicone button, and the conductive part can be a graphite layer.

During use, when the insertion part is inserted into the positioning hole, it exerts downward pressure on the elastic button, causing the elastic button to deform elastically. The conductive part at the bottom of the elastic button then electrically connects the first conducting pin and the second conducting pin, indicating that the insertion part (handle) has been properly inserted and the usage mode corresponding to that positioning hole has been selected. At this point, the push-button timer begins recording the duration of push-ups performed by the user in that mode.

Specifically, the data collector 2 can be an infrared counter 27 configured to be installed on the housing 3 to sense and count push-ups when the user performs push-ups. Moreover, the infrared counter is located on the central housing 31. During use, when the user has selected one of the usage modes, they will move closer to or farther away from the infrared counter while performing push-ups, enabling the infrared counter to sense and count the push-ups.

The above-described embodiments merely illustrate several embodiments of the present disclosure, and the description thereof is relatively specific and detailed, but it should not be construed as limiting the scope of patent protection. It should be pointed out that, for ordinary skilled in the art, several modifications and improvements can be made without departing from the concept of the present disclosure, which all fall within the scope of protection of the present disclosure. Therefore, the protection scope of the present disclosure should be determined by appended claims.

What is claimed is:

1. A push-up board, comprising a board body; and a plurality of data collectors arranged on the board body;

wherein the board body has at least two usage modes for user selection, when one of the at least two usage modes is selected, the data collectors are configured to collect data on push-ups under the one of the at least two usage modes;

wherein the board body comprises a housing and handles, wherein the housing has an exercise area, a plurality of positioning sections each corresponding to one of the at least two usage modes are arranged in the exercise area; when the handles are fitted with one of the positioning sections, one of the at least two usage modes corresponding to the one of the positioning sections is selected; and wherein when the handles are fitted with one of the positioning sections, the handles are configured to trigger one of the data collectors to start recording data on the push-ups.

2. The push-up board according to claim 1, wherein each handle includes at least one insertion part, the positioning sections include positioning holes, the data collectors correspond to the positioning holes, each insertion part is configured to trigger corresponding one of the data collectors when such insertion part is inserted into one of the positioning holes corresponding to the one of the data collectors.

3. The push-up board according to claim 2, wherein:

a bottom of each insertion part is provided with an elastic triggering component, each data collector is arranged at a bottom of a corresponding one of the positioning holes, and the elastic triggering component is configured to elastically trigger a corresponding one of the data collectors at the bottom of the corresponding one of the positioning holes.

4. The push-up board according to claim 2, wherein each positioning hole corresponds to one of the data collectors.

5. The push-up board according to claim 2, wherein the data collectors comprise a pressure sensor and a timer.

6. The push-up board according to claim 5, wherein the pressure sensor is configured to collect data on a number of the push-ups and a pressure exerted on the push-up board, and the timer is configured to collect data on duration of the push-ups.

7. The push-up board according to claim 5, wherein the pressure sensor is a thin-film pressure sensor.

8. The push-up board according to claim 5, wherein the timer is an infrared timer or a magnetic timer configured to detect the insertion part to initiate timing.

9. The push-up board according to claim 8, wherein the magnetic timer comprises a Hall effect sensor arranged in a corresponding one of the positioning holes and a magnet arranged at a corresponding one of the insertion parts.

10. The push-up board according to claim 5, wherein the timer is a push-button timer and is configured to start timing when a corresponding one of the insertion parts of the handles applies pressure to the push-button timer.

11. The push-up board according to claim 10, wherein a circuit board is arranged at a bottom of the positioning holes, the push-button timer comprises a first conducting pin, a second conducting pin, and an elastic button; both the first conducting pin and the second conducting pin are arranged on the circuit board and remain in a normally open state; a bottom of the elastic button is provided with a conductive part; when a corresponding one of the insertion parts of the handles applies pressure to the elastic button, the elastic button undergoes elastic deformation, causing the conductive part at the bottom of the elastic button to electrically connect the first conducting pin and the second conducting pin.

12. The push-up board according to claim 1, wherein one data collector is an infrared counter configured to be arranged on the housing to sense and count the push-ups when the user performs the push-ups.

13. The push-up board according to claim 12, wherein the housing comprises a central housing, and the infrared counter is arranged in the central housing.

14. The push-up board according to claim 2, wherein the usage modes comprise at least two of a chest mode, a back mode, a shoulder mode, and an arm mode.

15. The push-up board according to claim 14, wherein the exercise area is provided with a plurality of color markings, each usage mode corresponds to one of the color markings, and each color marking corresponds to one of the positioning sections.

16. The push-up board according to claim 15, wherein the positioning sections comprise a chest positioning section, a back positioning section, a shoulder positioning section, and an arm positioning section, the chest positioning section is marked with a first color marking, the back positioning section is marked with a second color marking, the shoulder positioning section is marked with a third color marking, and the arm positioning section is marked with a fourth color marking, so that one of the positioning sections is capable of being selected based on the color markings.

17. A push-up board, comprising a board body; and a plurality of data collectors arranged on the board body;

wherein the board body has at least two of a chest mode, a back mode, a shoulder mode, and an arm mode for user selection, when one of the usage modes is selected, the data collectors are configured to collect data under the one of the at least two usage modes;

wherein the board body comprises a housing and handles, wherein the housing has an exercise area, a plurality of positioning sections each corresponding to one of the at least two usage modes are arranged in the exercise area; when the handles are fitted with one of the positioning sections, one of the at least two usage modes corresponding to the one of the positioning sections is selected; and wherein when the handles are fitted with one of the positioning sections, the handles are configured to trigger one of the data collectors to start recording data on the push-ups.

18. A push-up board, comprising a board body; and a plurality of data collectors arranged on the board body;

wherein the board body has at least two of a chest mode, a back mode, a shoulder mode, and an arm mode for user selection, when one of the usage modes is selected, the data collectors are configured to collect data on push-ups under the one of the at least two usage modes; the data on the push-ups comprises at least one of a number of the push-ups, duration of the push-ups, pressure data on the push-ups;

wherein the board body comprises a housing and handles, wherein the housing has an exercise area, a plurality of positioning sections each corresponding to one of the at least two usage modes are arranged in the exercise area; when the handles are fitted with one of the positioning sections, one of the at least two usage modes corresponding to the one of the positioning sections is selected; and wherein when the handles are fitted with one of the positioning sections, the handles are configured to trigger one of the data collectors to start recording data on the push-ups.

* * * * *